US005906099A

United States Patent [19]

Jung et al.

[11] Patent Number: 5,906,099

[45] Date of Patent: May 25, 1999

[54] REFRIGERATOR

[75] Inventors: Markus Jung, Cologne; Dieter Sous, Erftstadt, both of Germany

[73] Assignee: Leybold Vakuum GmbH, Germany

[21] Appl. No.: 08/913,735

[22] PCT Filed: Mar. 15, 1996

[86] PCT No.: PCT/EP96/01126

§ 371 Date: Feb. 13, 1998

§ 102(e) Date: Feb. 13, 1998

[87] PCT Pub. No.: WO96/29552

PCT Pub. Date: Sep. 26, 1996

[30] Foreign Application Priority Data

Mar. 23, 1995 [DE] Germany ..... 195 10 620

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,321,926 | 5/1967 | Chellis | 62/6 |
| 3,625,015 | 12/1971 | Chellis | 62/6 |
| 4,180,984 | 1/1980 | Chellis | 62/6 |
| 4,446,701 | 5/1984 | Suzuki et al. | 62/6 |
| 4,622,823 | 11/1986 | Ishizawa et al. | 62/6 |
| 4,761,963 | 8/1988 | Kiese | 62/6 |
| 4,987,743 | 1/1991 | Lobb | 62/6 |
| 4,995,237 | 2/1991 | Strasser | 62/6 |
| 5,048,297 | 9/1991 | Sarcia et al. | 62/6 |

FOREIGN PATENT DOCUMENTS

| | | |
|---|---|---|
| 28 48 245 | 7/1979 | Germany . |
| 34 46 480 | 7/1985 | Germany . |
| 42 03 135 | of 1993 | Germany . |
| 43 18 406 | 12/1994 | Germany . |

OTHER PUBLICATIONS

German Search Report p. 2251.

*Primary Examiner*—Ronald Capossela
*Attorney, Agent, or Firm*—Wall Marjama Bilinski & Burr

[57] ABSTRACT

A refrigerator for cryogenic pumps, cryostats and the like, includes a housing having a cylindrical working volume inside the housing and a displacement element capable of moving in a reciprocal manner within the working volume. The displacement element is driven by a gas drive. To reduce vibrations, the displacement element is forcibly guided.

4 Claims, 1 Drawing Sheet

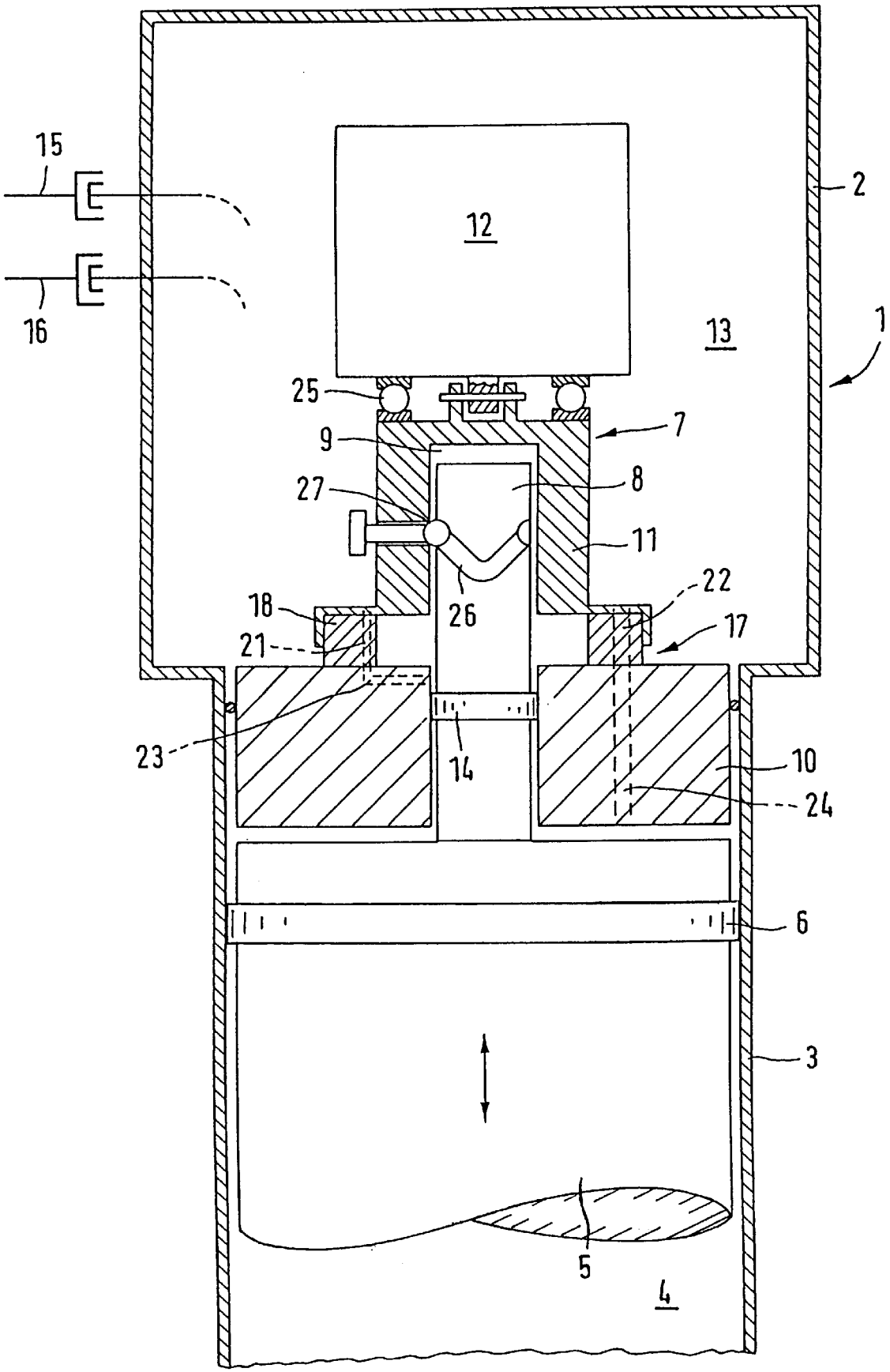
15
16
12
13
2
1
25
9
7
27
8
11
26
22
18
17
21
23
14
10
24
6
3
5
4

REFRIGERATOR

FIELD OF THE INVENTION

The invention relates to a refrigerator and more particularly to an improved gas-drive refrigerator having a reciprocally moving displacer.

Refrigerators are low-temperature cooling machines in which cyclic thermodynamic process occurs. They comprise a displacer which during the operation of the refrigerator moves back and forth in a cylindrical operating volume between two dead points. This displacer movement is the cause of undesired vibrations and noise.

Suggestions have already been made for damping the vibrations entailed in the operation of refrigerators. From European Patent Application 160 808 is already known to dispose within the operating volume a leaf spring. However, this forms a dead space reducing the performance of the refrigerator. Further suggestions for reducing the vibrations are described in EP A 437 661 and in DE A 43 18 406. Disclosed are refrigerators with a gas drive for the displacer. The gas drive comprises a cylinder-piston configuration. The desired vibration damping is intended to be attained through special measures in connection with the inlet or outlet of the gases into/from the cylinder of the gas drive or also into the operating volume.

SUMMARY OF THE INVENTION

The present invention is based on the task of damping the vibrations and noise occurring in a refrigerator with a gas drive. According to the invention this task is solved through the characterizing features cited in the patent claims. Due to the forced guidance of the displacer its movement can be predetermined to avoid for example the displacer impacting the housing in the region of its dead point. Vibrations and noise generated by impacts are completely suppressed in this solution. The gas drive is usefully equipped with the forced guidance. This yields a space-saving structure. It is especially advantageous to bring about the forced guidance with the aid of the rotational movement of a motor which serves for controlling a rotating valve. While this represents an additional loading of the motor, it is so slight however that a change of the dimensioning of the motors, previously serving only for the control of the rotating valve, is not required.

Further advantages and details of the invention will be explained in conjunction with an embodiment example shown in the Figure.

BRIEF DESCRIPTION OF THE DRAWING

FIG. 1 is an elevational view, partially in section, of a refrigerator in accordance with the preferred embodiment of the present invention.

DETAILED DESCRIPTION OF THE INVENTION

A refrigerator 1 depicted in the Figure comprises a two-part housing (motor casing 2, displacer casing 3). In the displacer casing 3 is disposed a cylindrical operating volume 4 in which a displacer 5 moves back and forth. For the purpose of sealing off the gap between the casing 3 and the displacer 5 a sealing ring 6 is provided.

In the region of its warm end the displacer 5 is equipped with a gas drive 7. The gas drive comprises a driving piston 8, formed on the displacer 5, as well as a cylinder 9. The cylinder 9 is formed by a bushing 10 and a pot component

11 which is coupled with a drive motor 12 disposed in the motor casing 2. In addition to guiding the piston 8, the bushing 10 has additionally the task of separating the operating volume 4 from the motor compartment 13. The sealing ring 14 serves to seal the gap between piston 8 and bushing 10.

Ports 15 and 16 for high- and low-pressure gas, via which driving gas and operating gas are supplied, are indicated schematically. For the gas control serves in known manner a rotating valve 17 formed by the annular component 18 and bushing 10. The annular component 18 forms the lower edge of the pot component 11 which rotates during the operation of the refrigerator and is equipped with bores which, in a manner not shown in detail, are connected with ports 15, 16. further bores are disposed in the stationary bushing 10, which are temporarily connected with the bores in the annular component 18 which results in the desired gas control. Shown by example are only bores 21 and 22 in the annular component 18 as well as the bores 23, 24 in bushing 10. The bore 23 terminates in the drive cylinder such that via bores 21, 23 the control of the drive gas can take place. Bore 24 terminates in operating volume 4. Via the bores 22, 24 the operating volume 4 is supplied with operating gas.

Between motor 12 and pot component 11 is usefully disposed an axial bearing 25. The bearing 25 permit a the axially acting forces to the motor.

The displacer casing 3 and the displacer 5 are shown only partially. If the refrigerator 1 is implemented as a single-stage refrigerator, only the displacer 5 is present in the operating volume 4. If the refrigerator is implemented as two- or multistage refrigerator, the displacer casing 3 is followed by two or more casing segments with a displacer each, whose movements correspond to the movement of the displacer 5 in known manner. As a rule, the displacers are conventionally and fixedly coupled one with the other.

In the present embodiment shown the gas drive 7 is equipped with a forcible guidance. Comprising an encompassing groove 26 on piston 8 and a projection 27 (pin, ball, need, bearing or the like) engaging into groove 26, on the pot component 11. Facing a section through piston 8, the groove 26 comprises segments which are inclined such that the displacer carries out a back-and-forth movement during the rotation of the pot component 11. The conformation of the groove 26 (slope, stroke) determines this movement. It can, for example, be forced such that displacer no longer impacts on casing 3 or on bushing 10. Groove 26 and projection 27 can also be exchanged.

A prerequisite for the desired movement of the displacer 5 is that it does not execute a rotational movement. Due to the relatively high friction between sealing rings 6 and 14 as well as casing 3 or bushing 10, respectively, this is usually ensured. Additionally however the option is given of providing known means for preventing a rotational movement of the displacer for example, providing a stationary pin on the casing, for engaging an axial slot in the displacer.

We claim:

1. Apparatus for reducing the vibrations of a displacer used in a cryogenic refrigerator, said displacer comprising:

a casing having a cylindrical operating volume; and a displacement element disposed in said operating volume, said displacement element being reciprocally movable therein; and said refrigerator including:

a gas drive for moving the displacement element in said operating volume, said gas drive including a piston provided on a front face of said displacement element and a cylinder, and means for forcibly guiding the movement of said displacement element;

a motor operatively connected to said gas drive, said motor being capable of generating rotational movement for effecting the forcible guidance of said displacement element: said apparatus including:

a rotating valve for controlling the supply of gas for operating said gas drive, said motor having means for controlling said rotating valve, wherein the control of said rotating valve simultaneously controls the forcible guidance of said displacement element.

2. A refrigerator as recited in claim 1, including a pot component coupled with said motor to form the cylinder of said gas drive, said pot component and said piston being equipped with said forcible guiding means.

3. A refrigerator as recited in claim 2, including a bearing disposed between said motor and said pot component.

4. A refrigerator as recited in claim 1, including a groove disposed in one of said piston, said displacement element and an inner wall of said pot component for engaging a projecting element disposed on a separate one of said pot component and said piston.

* * * * *